US007737372B2

(12) United States Patent
Dougherty, Jr. et al.

(10) Patent No.: US 7,737,372 B2
(45) Date of Patent: Jun. 15, 2010

(54) LEAK AND SPILL CONTAINMENT SCALE

(75) Inventors: Edward M. Dougherty, Jr., Ottsville, PA (US); Edward M. Dougherty, III, Perkasie, PA (US)

(73) Assignee: Scaletron Industries, Ltd., Plumsteadville, PA (US)

( * ) Notice: Subject to any disclaimer, the term of this patent is extended or adjusted under 35 U.S.C. 154(b) by 135 days.

(21) Appl. No.: 12/137,828

(22) Filed: Jun. 12, 2008

(65) Prior Publication Data

US 2008/0312488 A1 Dec. 18, 2008

Related U.S. Application Data

(60) Provisional application No. 60/934,416, filed on Jun. 13, 2007.

(51) Int. Cl.
*G01G 19/00* (2006.01)

(52) U.S. Cl. ..... 177/245; 220/571; 73/290 R; 73/296

(58) Field of Classification Search ..... 177/177, 177/238–245, 262; 220/571–573; 73/290 R, 73/291, 296
See application file for complete search history.

(56) References Cited

U.S. PATENT DOCUMENTS 3,353,615 A * 11/1967 Nekimken ..... 177/245
4,245,748 A * 1/1981 Kvamsdal ..... 220/571
4,274,500 A * 6/1981 Kuhnle ..... 177/25.15
4,630,697 A 12/1986 Hartman et al. ..... 177/211
4,957,177 A * 9/1990 Hamilton et al. ..... 177/211
5,527,052 A * 6/1996 Litin ..... 280/47.26
5,641,947 A * 6/1997 Riddle, Jr. ..... 177/126
5,927,142 A * 7/1999 Mercer ..... 73/296
6,019,243 A 2/2000 Marino ..... 220/573
6,148,667 A * 11/2000 Johnson ..... 73/296
6,189,720 B1 * 2/2001 Gillispie ..... 220/571
6,273,021 B1 * 8/2001 Pembroke ..... 116/228
6,407,351 B1 * 6/2002 Meyer et al. ..... 177/238
6,789,435 B2 * 9/2004 Hopkins ..... 73/862.632
6,845,298 B2 1/2005 Nelson et al. ..... 700/265
7,110,861 B2 9/2006 Nelson et al. ..... 700/265
7,234,346 B2 6/2007 Nelson ..... 73/149

OTHER PUBLICATIONS

4-Drum SpillDeck and 4-Drum SpillDeck with bladder from Spill 911® (2 web pages dated May 23, 2007).
LLE Series Liquid Level Sensor from Honeywell (4 catalog pages) issue Jun. 3, 2005 © 2001-2005.

* cited by examiner

*Primary Examiner*—Randy W Gibson
(74) *Attorney, Agent, or Firm*—Fox Rothschild, LLP

(57) ABSTRACT

A scale assembly for weighing potentially hazardous materials comprise a containment deck designed to support a container from which materials are dispensed. The containment deck is preferably provided with sufficient storage capacity to capture spillage or leaks from the container and is supported on a low-profile platform supported in turn by load cells which generate signals indicative of the weight of the contents of the container and of any spillage within the containment deck. The containment deck is further equipped with a level detector typically positioned near the bottom of the deck for generating signals indicating the presence of leakage or spillage from the container.

7 Claims, 5 Drawing Sheets

FIG.1
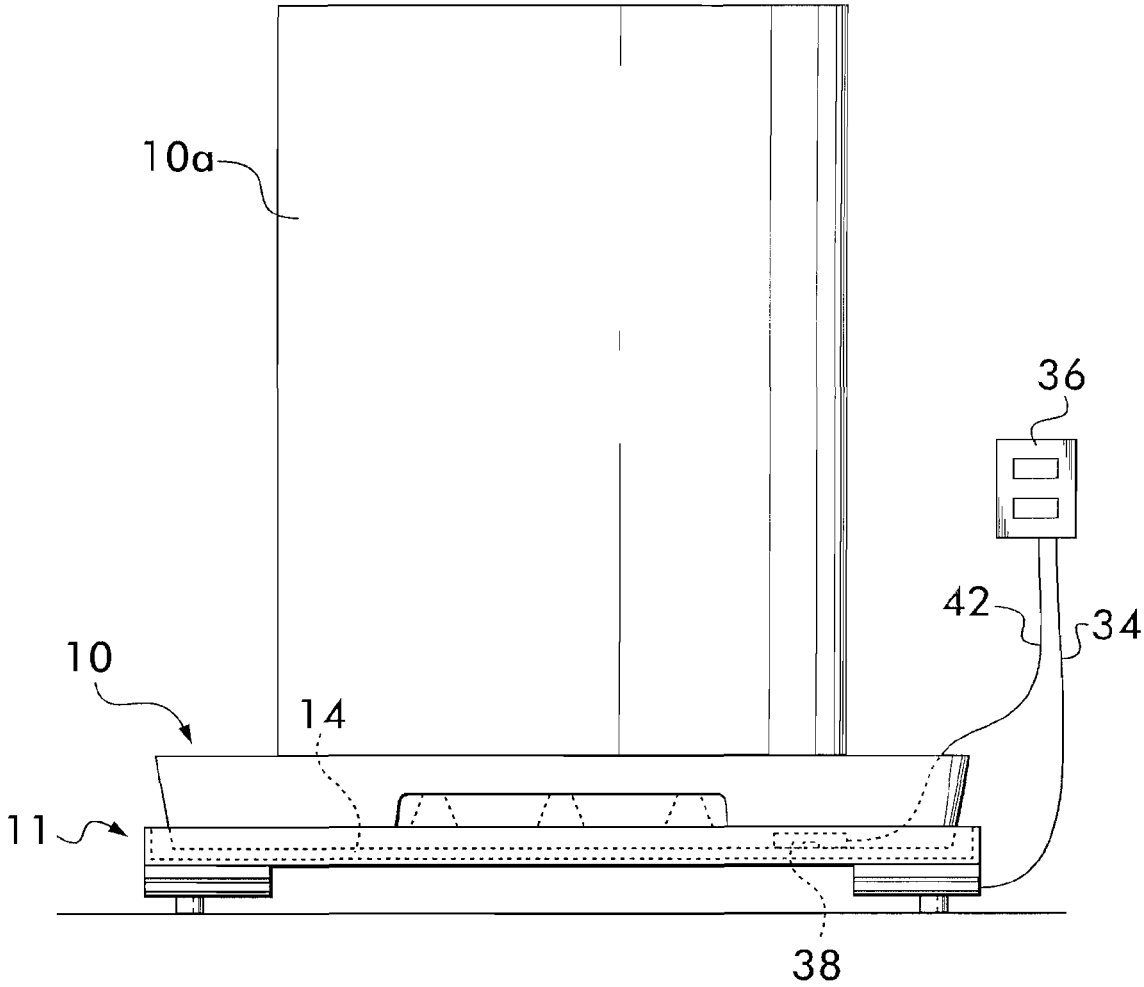
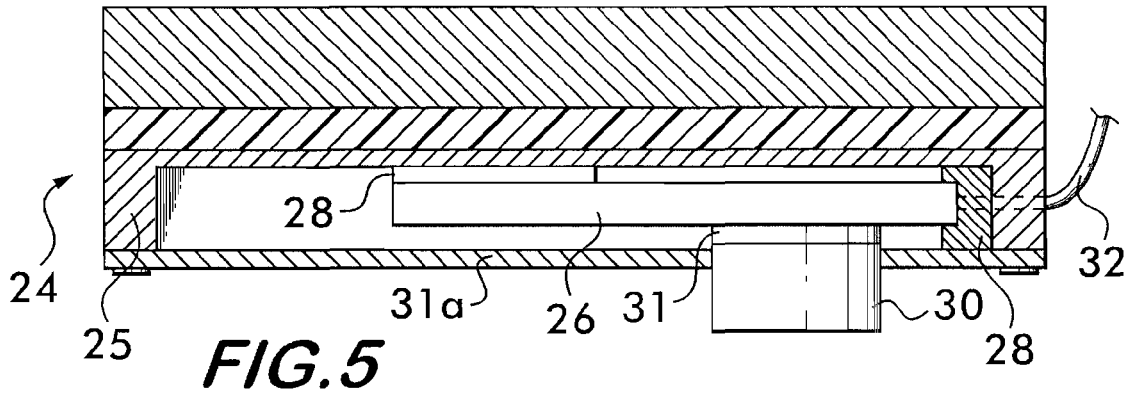
FIG.5

FIG. 6
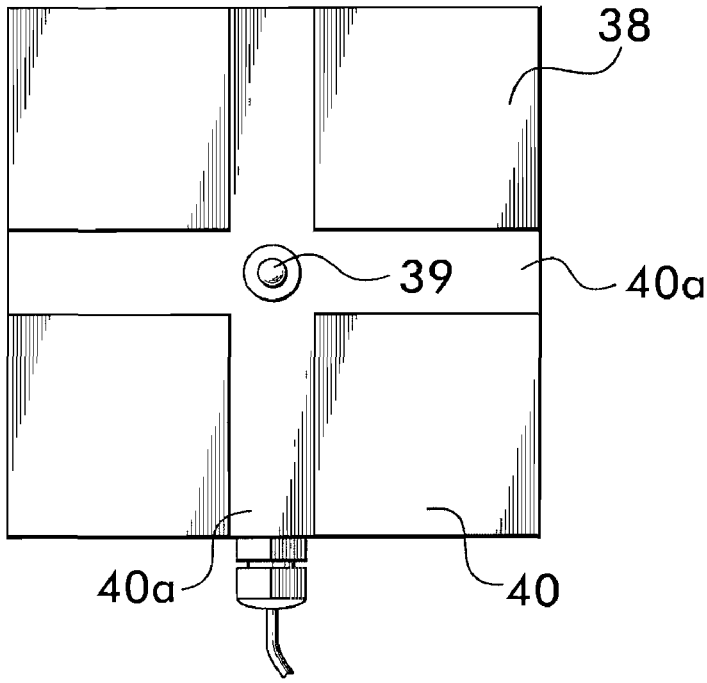
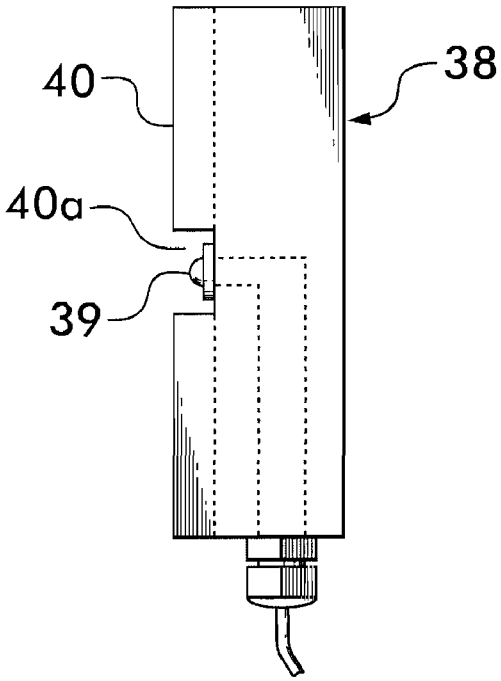
FIG. 6A

LEAK AND SPILL CONTAINMENT SCALE

CROSS-REFERENCE TO RELATED APPLICATION

This application is based on and claims priority to U.S. Provisional Application No. 60/934,416, filed Jun. 13, 2007.

FIELD OF THE INVENTION

This invention relates to weighing scales and, in particular, to scales having load cells supported on the underside of a platform wherein the platform receives a containment deck for support of one or more containers of chemicals in liquid or in dry bulk, generally particulate form. The containment deck is preferably provided with sufficient storage capacity to capture and contain spillage caused by spilling or leaks, and in the case of liquids, may be connected to an expandable bladder or over-spill vessel having the capacity to capture major spills beyond the capacity of the deck.

BACKGROUND OF THE INVENTION

In the handling of such materials, particularly in the unloading and loading of containers of the materials and for dispensing from them, it is a generally followed practice, increasingly required by law, to support the full containers, such as tanks, drums, intermediate bulk containers or tote bins, on spill containment decks which may be raised above the floor or other support surface. Such containment decks are provided with a sump designed to contain spillage from the containers as may occur when the container is being filled or when its contents are withdrawn. The decks are generally constructed of an inert material which is non-reactive with materials being dispensed, and generally have a reservoir which is large enough to accommodate spillage or leaks, thereby preventing the container contents from contaminating ground water or reacting with the concrete or other floor materials or from coming into contact with the shoes or clothing of the workers dispensing or filling the containers or transporting the materials as may be required.

It is highly desirable to accurately keep track of amounts of materials dispensed from or added to containers, and for this purpose, it is desirable that the container be supported on a scale for the purpose of monitoring amounts withdrawn and the amount remaining in the container at any given time. Inclusion of the amount of spillage in the amount weighed is considered to be important and to be taken into account in evaluating usage and the efficiency of various treatment process for which the materials are intended to be used. It is also particularly important to separately measure the spilled amount so that the risk of any harm can be accessed.

A need exists for a low-profile weighing apparatus for support of a containment deck. Such apparatus must be of minimal height, as the containers can be quite heavy and difficult to manage when placed on the surface of a conventional containment deck. If the support surface of the containment deck is too high, conditions of instability may be created and contribute to accidents resulting in spillage. The containers may be heavy and difficult to load and unload from the deck under the best of circumstances. Providing a support system and weighing apparatus with a low overall profile is critical to avoiding accidents to workers and to the environment.

To date, there has been no known containment deck scale that fills these requirements.

SUMMARY OF THE INVENTION

According to the invention, a low-profile supporting platform is provided which is sized to receive a conventional spill and leak containment deck on which a container of material to be dispensed is positioned. The platform base is generally open and provided with supporting pieces and a railing structure extending upwardly from the base around its perimeter. A plurality of load cells are preferably located adjacent to or at the corners of the platform. The load cells are encapsulized within sealed housings and project downwardly therefrom to engage the floor or other support structure on which the containment deck and the container of the material is to be stowed. Associated load circuitry is housed within the housings for the load cells. Preferably, the housings are formed of a material which is inert with respect to the contents of the containers, thus protecting the load cell circuit components as well as the load cells themselves from attack by corrosive materials that may be dispensed from the containers. Suitable circuitry for receiving and transmitting signals representative of the weight of the container is mounted preferably centrally of the platform on its underside or in some other suitable location for transmission to a location remote from the platform where readings representative of the weight of the container are displayed. In a preferred form of the invention, the leak containment deck is provided with at least one sensor for detecting spillage or leakage captured within the containment vessel. By signaling spilled liquid before an over-spill condition is created, major catastrophes can be avoided. The signaling apparatus preferably has the capability of providing a reading of the amount of the leakage. Thus, the potential for harm can be assessed and the amount lost can be better accounted for.

BRIEF DESCRIPTION OF THE DRAWINGS

How the foregoing and various objects and advantages of the invention are achieved will appear more fully from the accompanying drawings in which:

FIG. 1 is a schematic view showing the various elements of a preferred embodiment of a scale according to the invention;

FIG. 5 is a view of the preferred form of a load cell housing used in the scale of FIGS. 1-4; and FIG. 6 is a view of a liquid level sensor used in the scale of FIGS. 1-5.

DETAILED DESCRIPTION

Figure 2:
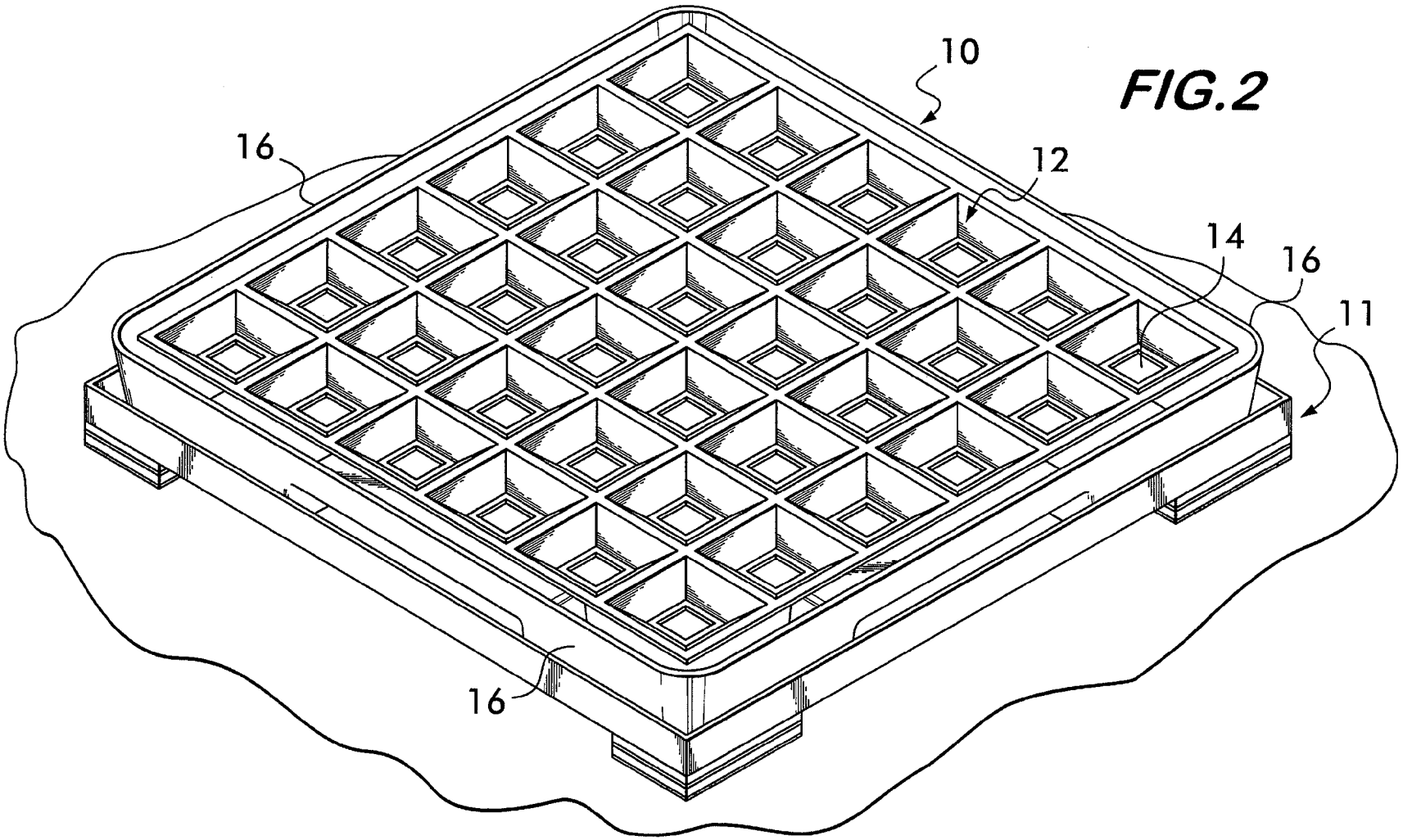
FIG. 2 is an overall perspective view of a preferred form of a scale containment deck according to the invention.

Referring first to FIGS. 1 and 2, a containment deck 10 for support of a drum 10*a* containing a chemical in dry or liquid form is shown mounted on a scale platform 11. The containment deck 10 is generally pan-shaped and comprises a molded plastic, open support grid 12 spaced above floor 14 and surrounded by side walls 16. The grid and the containment deck are preferably formed of polyethylene or other material which is inert and non-reactive with the contents of a container which is intended to be supported on its surface. The structure acts as a sump for capturing spillage as it may occur when the container contents are dispensed or as the container is being filled. The sump is typically designed to hold about 15 gallons of liquid. Sumps of other capacity may be provided. The spill capacity may be further enhanced by provision of a flexible, expandable bladder connected to the deck into which liquid may be contained in excess of the capacity of the sump. The decks are usually designed to support a conventional drum, such as a standard 55 gallon drum, although larger sizes and varieties of containers also may be accommodated. In addition, decks sized to support more than one container are known, and it is within the scope of the invention that containment decks and support platforms be designed to support one or more containers of a size smaller or larger than the aforementioned 55 gallon drum. It is known, for example, to provide spill decks having a load-bearing capacity of one, two and even six drums with a load-bearing capacity of 3000 lbs and sumps of a capacity substantially in excess of 100 lbs or 66 gallons. A typical one drum spill deck in widespread use is about 26" square and has an overall height of about 5¾".

Figure 3:
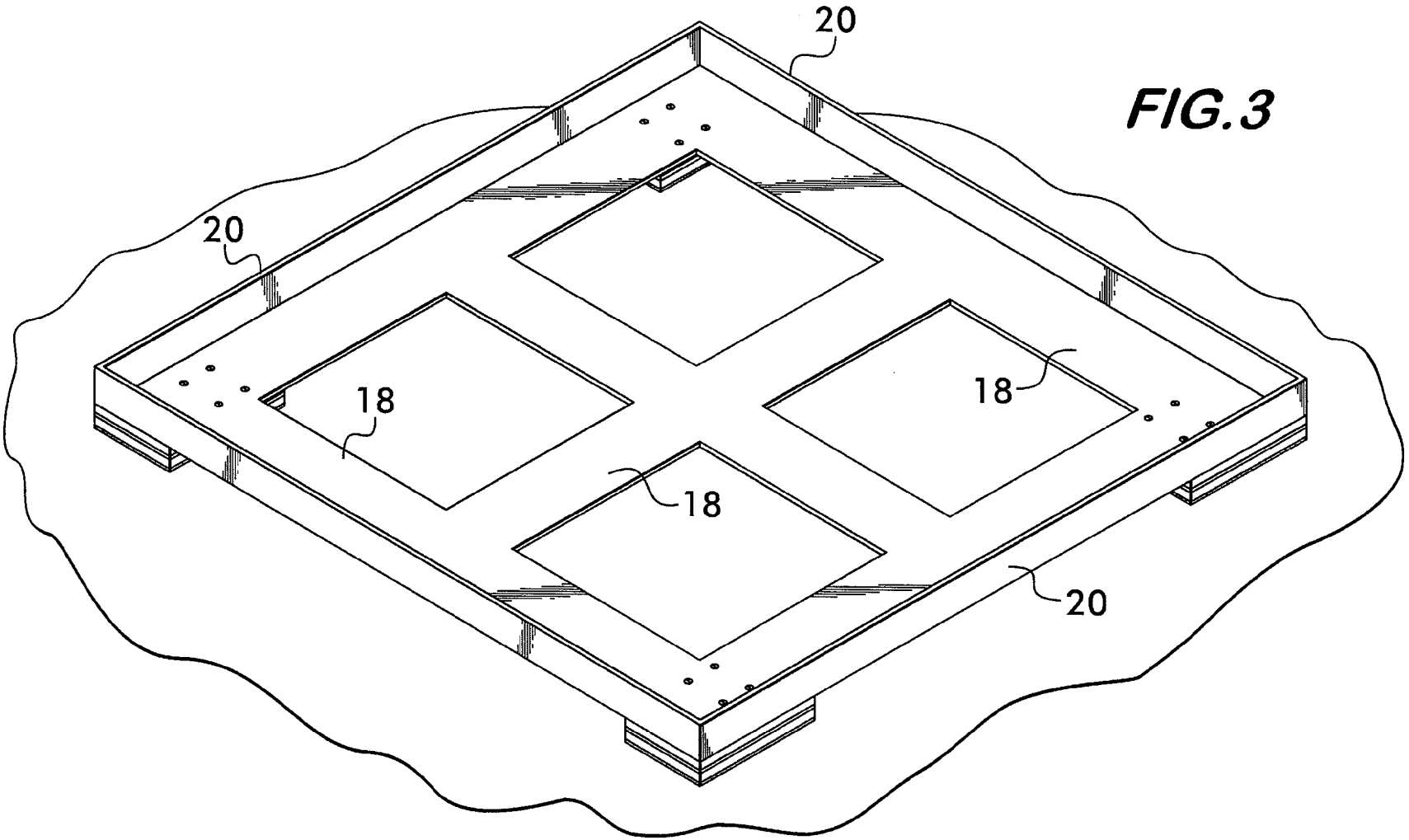
FIG. 3 is an overall top view of the containment scale of FIGS. 1 and 2 with the spill containment deck removed for clarity of explanation.

In FIG. 3, the support platform 11 is shown as comprising a rectangular support structure and includes supporting base plates 18. Extending upwardly around the periphery thereof and joined thereto are vertically extending retaining wall portions 20. Additional support is provided by supporting cross pieces. The platform is typically made of steel, although in some instances, plastic materials may be employed, depending upon the load-bearing capacity requirements and the resistance to attack necessary to provide protection against damage by chemical attack by the contents of the containers.

Figure 4:
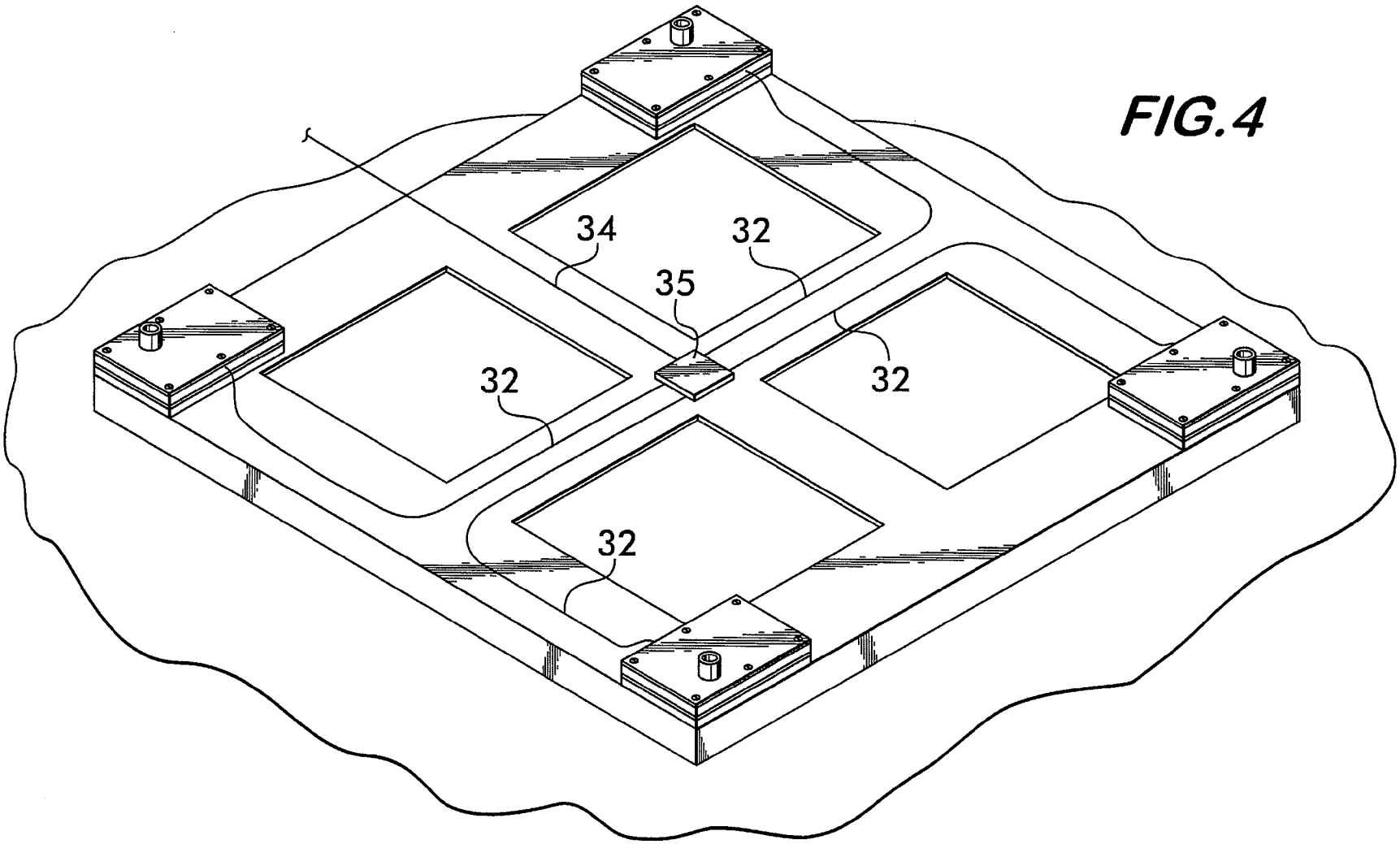
FIG. 4 is an overall bottom view of the containment scale of FIGS. 1-3.

In FIG. 4, the platform 11 is turned over to indicate a typical positioning of load cells 24. A preferred form of load cell housing 24 is illustrated in FIG. 5. The cell housing includes an inverted, generally cup-shaped member 25 formed of polyvinyl chloride or other material resistant to damage by the range of materials generally anticipated to be dispensed from the containers being weighed. The load cell 26 is suspended within the cup on supports 28 and 29. To allow for flexure of the load cell 26, its uppermost surface is spaced from cupped-shaped member 25. A foot 30, preferably made of stainless steel, supports the load cell. A compressible spacer 31 is provided intermediate to the cell 26 and the foot 30 to allow for limited relative movement between the cell and the foot. The foot is secured to the cell by a bolt (not shown). A seal 31*a*, preferably of polyethylene, seals the interior of the cup from moisture and chemical attack. The cells are mounted adjacent the corners of platform 11.

Low profile load cells which are suitable for the purpose are available from Flintec Inc. of Hudson, Mass. A preferred load cell housing and foot for a 375KG load cell has an overall height of about 1.4". As explained in U.S. Pat. No. 4,630,697, the disclosure of which is incorporated herein by reference, weight transmitted to the load cell housing causes flexure of the load cell within the space in the housing. An embedded resistor network responds to differential stretching and compressing of the upper and lower surfaces of the cells giving a signal representative of the load carried by each cell. The signals from the various load cells are transmitted by conductors 32 as shown at FIG. 4 to a central controller 35 on the bottom of the base. The signals are totalized and may be digitized and transmitted via conductors 34 to a display and recording device 36 typically located remotely from the platform. Alternatively, a low-frequency transmitting device, such as an RFID, may be employed, thereby eliminating the conductors 34.

Preferably, the spill containment deck is provided with a liquid level sensor as shown schematically at 38 in FIG. 1. A preferred form of liquid level sensor operates on the principal of total internal reflection. As illustrated in FIGS. 6 and 6A, the sensor provides an LED light source and phototransistor housed within a plastic hemispherically-shaped dome 39 within a housing 40 preferably mounted within the containment deck 10 on the bottom surface 14. Preferably, the dome is recessed within intersecting grooves 40*a* on the bottom surface of housing 40 When no liquid is present in the containment deck, light from the LED is internally reflected from the dome to the phototransistor. If a spillage occurs sufficient to cover the dome 39, the refractive index of the dome changes, allowing light from the LED to escape. This reduces the light received from the phototransistor and produces a signal indicative of the presence of liquid. A liquid level sensor operating on the principal described above is an LLE series liquid level sensor available from Honeywell International, Inc., Motherwell U.K. (www.honeywell.com). The sensor housing 40 is preferably formed of material resistant to attack by the chemicals being dispensed and, as shown in FIG. 1, is mounted on or immediately adjacent the floor of the deck. The dome 39 faces downwardly towards the floor 14 of the containment deck, so as to generate an alarm signal before the spill becomes a major catastrophe. The signal indicative of the presence of liquid may be communicated by conductors 42 to a separate display on the weight indicator 36 or may be an audible or visual alarm system or both and may also include a display of the amount of the spill. Alternative placements of the sensor 38 considered to be within the scope of the invention include placement on the inner surface of wall 16 of the deck 10. Where use takes place in locations where the humidity might cause moisture to condense on the dome sufficient to cause a signal indicative of a spill, the sensor could be placed with the dome 39 facing away from the support surface.

In summary, the invention comprises a low-profile weighing scale for support of a containment deck for containers of corrosive materials, wherein the containment deck has a sump for receiving spillage from a container. The weighing scale includes a support platform for receiving the containment deck. A plurality of load cells supports the platform on a supporting surface. The load cells are preferably no greater than about 1.5" inches in height, thereby minimizing the vertical distance between the support surface and load-supporting surface of the containment deck. Preferably, the scale platform is square or rectangular and can be provided to support the exterior dimensions of standard containment decks and containers. A low railing surrounding the support surface of the platform 11 permits easy loading and unloading of the containers on the deck. A platform for support of a deck receiving one standard size container is about 26" square and has a support surface which is about 1½" above the floor. The platform may be constructed of a material resistant to corrosive contents of the containers or coated with a non-corrosive coating material. The claimed apparatus and method also include detection means for detecting the presence of leaks or spillage within the containment deck.

What is claimed is:

1. A spill containment system comprising a support platform having a wall around its perimeter and a base, a containment deck for support of a container of a bulk chemical in liquid or particulate form, said containment deck being supported on said platform within the confines of said wall, the containment deck having a low profile wall and a floor, the wall and floor being joined to retain spillage or leakage from the container disposed on said deck, a plurality of load cells spaced around the periphery of the support platform, said load cells being positioned to provide the sole support for the support platform and the load carried thereby, a supporting foot for each load cell, a housing having a seal for encapsulating the load cell, the housing being formed of a material which is inert with respect to the contents of the container, the seal being sandwiched between the foot and the load cell and circuitry connecting to the load cells for totaling load signals received from each cell.

2. A spill containment system according to claim 1, wherein the load cell housing comprises a cup-shaped member opening downwardly away from the support platform, the housing being constructed of polyvinyl chloride, wherein the cup-shaped member receives the load cell seal wherein spacing is provided within the housing for flexure of the load cell, wherein the seal is formed of polyethylene.

3. A spill containment system according to claim 2, a deposit of a potting material within the recess surrounding the load cell and wherein the load cell is supported for flexure within said recess, a downwardly facing opening through the potting material, and a non-compressible spacer member between the load cell and the foot for transmitting loads therebetween.

4. A spill containment system according to claim 1, further including a sensor within the containment deck positioned to detect spillage or leakage before the spill capacity of the deck is reached and circuitry for detecting the amount of the spillage and signaling the presence of the spillage before the spill capacity of the deck is exceeded.

5. A spill containment system according to claim 4, wherein the circuitry further includes an indicator for recording the amount of the spillage.

6. The spill deck according to claim 4, further including a housing for said sensor, said housing having a central recess, a light responsive liquid level sensor having transparent hemispherical globe within said recess, said sensor being responsive to the presence of spillage or leakage of said bulk on said globe for signaling the presence of bulk chemical within said containment deck and an indicator indicating the presence of said spillage or leakage.

7. A containment deck for containers of chemicals, said containment deck having a sump for receiving spillage from a contained supply of said chemicals, a low profile platform support for said containment deck, a plurality of load cells for support of said platform on a supporting surface, said load cells being equidistantly spaced around the periphery of the platform and control circuitry electrically contacting said load cells including a display device, said display device providing readings representative of the weight of a container and any spillage contained within said sump, said display device separately indicating the amount of any spillage within said sump.

* * * * *